United States Patent [19]

Mizutani et al.

[11] Patent Number: 4,929,102

[45] Date of Patent: May 29, 1990

[54] RIBBON PROTECTOR INCLUDING ELECTRO-CONDUCTIVE ELEMENTS AND PLATEN GAP ADJUSTMENT DEVICE INCORPORATING THE SAME

[75] Inventors: Minoru Mizutani; Hiroshi Kikuchi; Shoichi Watanabe; Kuniharu Hayashi; Masanori Maekawa, all of Tokyo, Japan

[73] Assignee: Oki Electric Co., Ltd., Tokyo, Japan

[21] Appl. No.: 131,093

[22] Filed: Dec. 10, 1987

[30] Foreign Application Priority Data

| | | | |
|---|---|---|---|
| Dec. 10, 1986 | [JP] | Japan | 61-292608[U] |
| Dec. 10, 1986 | [JP] | Japan | 61-292609 |
| Dec. 10, 1986 | [JP] | Japan | 61-189062 |

[51] Int. Cl.[5] ..... B41J 35/26

[52] U.S. Cl. ..... 400/248; 400/56

[58] Field of Search ..... 400/55, 56, 57, 58, 400/59, 60, 247, 248, 248.3, 472

[56] References Cited

U.S. PATENT DOCUMENTS

| | | | |
|---|---|---|---|
| 3,793,947 | 2/1974 | McVey | 400/472 X |
| 3,960,256 | 6/1976 | Bickoff et al. | 400/55 X |
| 4,088,215 | 5/1978 | Bader | 400/59 X |
| 4,165,188 | 8/1979 | Rempel | 400/248 X |
| 4,268,177 | 5/1981 | Veale | 400/55 |
| 4,365,900 | 12/1982 | Gottsmann et al. | 400/57 |
| 4,390,292 | 6/1983 | Krenz | 400/57 X |
| 4,496,256 | 1/1985 | McMorrow et al. | 400/59 X |
| 4,652,153 | 3/1987 | Kotsuzumi et al. | 400/56 |
| 4,657,415 | 4/1987 | Kikuchi et al. | 400/59 |
| 4,676,675 | 6/1987 | Suzuki et al. | 400/59 X |
| 4,676,681 | 6/1987 | Kikuchi et al. | 400/247 |
| 4,738,552 | 4/1988 | Kikuchi et al. | 400/59 |

FOREIGN PATENT DOCUMENTS

| | | | |
|---|---|---|---|
| 3521093 | 12/1985 | Fed. Rep. of Germany | 400/59 |
| 0049286 | 5/1981 | Japan | 400/59 |
| 0148682 | 9/1982 | Japan | 400/248 |
| 0151277 | 9/1983 | Japan | 400/55 |
| 0057767 | 4/1984 | Japan | 400/57 |
| 0079989 | 5/1985 | Japan | 400/248 |
| 0154091 | 8/1985 | Japan | 400/55 |
| 0239265 | 11/1985 | Japan | 400/248 |
| 0240483 | 11/1985 | Japan | 400/56 |
| 0250963 | 12/1985 | Japan | 400/56 |
| 0250977 | 12/1985 | Japan | 400/56 |
| 0031275 | 2/1986 | Japan | 400/59 |
| 0152462 | 7/1986 | Japan | 400/55 |
| 0171377 | 8/1986 | Japan | 400/59 |

*Primary Examiner*—Ernest T. Wright, Jr.
*Attorney, Agent, or Firm*—Spencer & Frank

[57] ABSTRACT

A ribbon protector is used for protecting paper from contamination by an ink ribbon in a printer, where the protector is inserted between paper located between a platen and a printing head. The printing head facing the platen performs spacing movement for printing. Two connected plate-like elements are provided with through openings for passage of the pin of the printing head. Mutually engageable electroconductive elements are provided on the inner walls of the two plate-like elements, at least in the area where they are compressed by the tip of the printing head, and spacers which are made from resilient materials are located between the two plate-like elements.

9 Claims, 9 Drawing Sheets

RIBBON PROTECTOR INCLUDING ELECTRO-CONDUCTIVE ELEMENTS AND PLATEN GAP ADJUSTMENT DEVICE INCORPORATING THE SAME

BACKGROUND OF THE INVENTION

The present invention relates to a ribbon protector which is installed in a printer, wherein printing is performed by a printing head facing a platen and performing a spacing movement for printing, and more particularly, in a printer which has a platen gap adjustment function for adjusting a distance between the platen and the printing head with regard to the thickness of paper set into the printer. The ribbon protector is installed between the paper and an ink ribbon for protecting paper from contamination by the ink ribbon.

The present invention also relates to a platen gap adjustment device which is intended for adjustment of the distance between the surface of paper which is laid onto a platen and the tip of a printing head in a printer which carries out the printing operation by means of the above-mentioned printing head which performs spacing movements with regard to the platen.

In order to protect a printer in which printing is performed by a printing head facing a platen and performing spacing movement, from a decrease in the quality of printing, breakage of the head pin, contamination of paper by an ink ribbon, and from inaccurate spacing movements of the carriage, it is necessary to maintain a predetermined distance between the surface of the paper and the tip of the printing head in relation to variations in the thickness of the paper.

FIG. 1 is a perspective view of a known printer which incorporates a paper thickness detection function and a platen gap adjustment function.

In this drawing, reference numeral 1 designates a platen, and 2 designates a printing head which is located in front of platen 1 and fulfills a printing function by being moved with a carriage 4 which performs spacing movements along a carriage shaft 3.

Both ends of carriage shaft 3 are fixed to cams 5. Reference numeral 6 designates a pulse motor which rotates the above-mentioned cams 5 through gears *7a* and *7b*. The printer is also provided with a spring 8, a slit disk 9, and a photoelectric sensor 10 which detects pulses produced by rotation of the above-mentioned slit disk 9. Through slit disk 9 and photoelectric sensor 10, it is possible to determine the moment when pulse motor 6 is stopped.

Reference numeral 11 designates a paper set between platen 1 and printing head 2, and 12 designates an ink ribbon. In the known device, a ribbon protector, which is intended for protection against contamination by a ribbon 12, does not have any relation to the platen gap adjustment function and therefore is not shown in the drawings.

The mechanism described above maintains a constant distance between the surface of the paper 11 and the tip of the printing head 2 at different thicknesses of paper 11 inserted into the printer in the following manner.

First of all, when paper 11 is guided around platen 1, the pulse motor 6 turns in a forward direction, and through gears *7a* and *7b*, rotates cams 5 rigidly attached to carriage shaft 3, so that carriage shaft 3 is turned and moved in a direction of withdrawal from platen 1 which is indicated by an arrow labelled X in FIG. 1.

At the same time, carriage 4 and printing head 2 installed on carriage 4 are also moved in a direction indicated by the arrow labelled X away from platen 1 and stop in a predetermined position.

Pulse motor 6 is then turned in a reverse direction which is opposite to the direction indicated by the arrow labelled X, i.e., so that print head 2 approaches platen 1, and abuts the platen 1 clamping paper 11 and ink ribbon 12.

Now, the printing head 2 cannot move further toward platen 1.

At this moment, slit disk 9 is at a halt, photoelectric sensor 10 does not generate pulses, and the system detects a stop state of pulse motor 6. From this point, for the second time, pulse motor 6 rotates in the forward direction only for a predetermined amount, so that a specified gap is obtained between the surface of paper 11 and the tip of the printing head 2.

Because normally the above-mentioned predetermined amount of rotation is constant, the above-mentioned specified gap between the surface of paper 11 and the tip of printing head 2 can be maintained constant, irrespective of the thickness of paper 11.

However, as shown in FIG. 2, the pulse motor 6 continues to rotate even after contact of the printing head 2 with the surface of the paper 11 because even after the contact, the clamped paper 11 and ink ribbon 12 can be further compressed and the carriage shaft 3 and the carriage frame FR can be bent, until the reaction of the shaft 3 coincides with the pulse-motor torque, when the pulse motor 6 is stopped. That is the pulse motor 6 stops only when it overruns the zero-gap condition by a certain value $\Delta N$.

Because the value of overrun $\Delta N$ depends on the pulse-motor torque, variation of the initial torque of the pulse motor 6, reduction of the torque because of an increase in temperature, fluctuations of voltage, or the like causes changes in the value of overrun. As a result, the return stroke of the printing head 2 is unstable.

Moreover, in the device of the type described above, the platen gap is adjusted indirectly. That is, the gap adjustment is made without taking account of the distortions of the carriage shaft 3. As a result, the accuracy of the adjustment is low.

Furthermore, because the platen gap is adjusted through the rotation of the carriage shaft 3, the mechanism has increased overall dimensions, as it requires that rotary means such as gears *7a* and *7b*, as well as drive means, such as a motor 6 for driving the above-mentioned rotary means, be installed on the end of the carriage shaft 3.

A further problem associated with the prior art device is its high cost resulting from the use of the slit disk 9 and photoelectric sensor 10.

SUMMARY OF THE INVENTION

It is an object of the present invention to eliminate the above disadvantages and to provide a device wherein the thickness of the paper is detected without involvement of a physical reaction which upsets the adjustment of the mechanism for adjusting the platen gap of a printer, and wherein the distance between the surface of the paper and the tip of the printing head is maintained at a specified value irrespective of the paper thickness.

Another object of the invention is to prevent deterioration in the quality of printing, protect the head pins from breakage, exclude contamination by the ink ribbon, and prevent inaccurate spacing movements of the carriage, through the maintenance of the distance between the surface of the paper and the tip of the printing head irrespective of the paper thickness.

A further object of the present invention is to provide a device for adjusting the platen gap in which the gap between the tip of the printing head and the surface of the paper is maintained constant with regard to variation in the thickness of the paper, so that it reduces the possibility of breakage of head pins, contamination by the ink ribbon, instability of movements of the carriage, and a decrease in quality of printing.

A further object of the present invention is to provide a device for direct adjustment of the platen gap which is kept at an accurate and predetermined value.

A further object of the invention is to provide a device for adjustment of the platen gap, which does not involve an increase in the overall demensions of the drive mechanism.

According to one aspect of the invention, there is provided a ribbon protector, that is normally used for protecting the paper from contamination by the ink ribbon and is located in front of the printing head, has a pressure detection function which is used for detecting the platen gap zero condition, i.e., for detecting the reference position for the platen gap adjustment.

More specifically, the ribbon protector according to the invention is characterized by the fact that the ribbon protector, which is intended for protecting paper from contamination by the ink ribbon in a printer, where printing is performed by the printing head facing the platen and performing spacing movement, and where the protector is located between the paper that is set between the platen and the printing head, and an ink ribbon, is provided with: two overlapped plate-like elements of identical shape which have through openings for passage of the pin of the printing head; mutually engageable electroconductive elements located on inner walls of the above-mentioned two plate-like elements, at least in the area where these elements are compressed by the tip of the printing head; and spacers which are made from resilient material and located between said two plate-like elements. The above-mentioned ribbon protector has a function of detecting the thickness of the paper.

When, in the above-described device, a compression force is applied in the horizontal direction, the spacers are compressed, and the conductive elements, which are facing each other and located on inner walls of the above-mentioned two plate-like elements, come into mutual contact and become electrically connected.

Because the ribbon protector of the present invention is located between the platen and the printing head, the pressure in the horizontal direction is created when the printing head approaches the platen, and comes into contact with the ribbon protector. By positioning the conductive portions of the plate-like elements to come into mutual contact compressing the spacer when the printing head is in contact with the paper at a predetermined pressure, when the printing head approaches the platen, and the platen gap becomes equal to zero, the spacer is compressed and the electroconductive elements conduct. This conduction can be used for detection of the paper thickness, and for detection of a predetermined reference position of the head with respect to the platen, which is the platen gap zero position.

According another aspect of the invention, there is provided a platen gap adjustment device in which the platen gap is adjusted by moving the entire carriage itself on which the printing head is installed on the carriage towards or away from the platen.

More specifically, the platen gap adjustment device is characterized in that: it is provided with means for automatically displacing the rear end of the carriage to rotate the carriage about a carriage shaft so that the printing head is moved toward or away from the platen; the ribbon protector has an electrode for being conductive when a predetermined pressure is achieved during adjustment; the carriage has a connector in which the above-mentioned electrode is inserted; and the device is provided with means for obtaining a reference position for the adjustment of the platen gap on the basis of the conduction of the electrode of the ribbon protector and driving the displacement means.

In operation, the rear end of the carriage is displaced (e.g., upward) by the displacing means driven from the drive means so that the printing head mounted above the carriage is moved forward, toward the platen. The platen gap is thus directly reduced. When the displacement means moves the rear end of the carriage in the opposite direction (e.g., downward), the carriage is rotated in the opposite direction and the printing head is moved away from the platen, and the platen gap is thus directly increased.

When the tip of the print head approaches the platen and the platen gap becomes equal to zero, the electrode of the ribbon protector becomes conductive. This condition can be used for detecting the paper thickness, as well as for obtaining the reference position for adjustment of the platen gap of the printing head. The same factor is used for drive control of the drive means.

According to a further aspect of the invention, there is provided a platen gap adjustment device which provides: means for manually displacing the carriage shaft toward or away from the platen; a ribbon protector which is provided with an electrode for being conductive when a predetermined pressure is achieved during adjustment; a carriage with a connector inserted into the above-mentioned electrode; and indicating means which indicates, on the basis of a signal obtained from the ribbon protector through the connector, that a reference position used for a platen gap adjustment procedure is achieved.

The above-mentioned displacement means comprise: a lever controlled by an operator; means moving together with the lever for changing the platen gap; and a plurality of lever fixing means for fixing the lever in predetermined positions.

In the case of adjustment of the platen gap in the device of the invention, an operator manipulates the lever and causes stepwise displacements of the carriage shaft toward the platen. As a result, the platen gap is reduced, the ribbon protector abuts the paper on the platen, and is pressed by the printing head.

When the pressure on the ribbon protector is increased and reaches a predetermined value, the electrodes becomes conductive and the indication means generates a signal indicating that the platen gap is in the reference position.

When the indication means generates the above-mentioned signal, the operator returns the lever back for a predetermined number of steps (e.g., one step) and locks it in this position. In this manner, the platen gap is adjusted for paper of different thickness.

Thus, the problem inherent in the conventional device is solved.

DETAILED DESCRIPTION OF THE PREFERRED EMBODIMENTS

Embodiments will now be explained with reference to the accompanying drawings.

Figure 3:
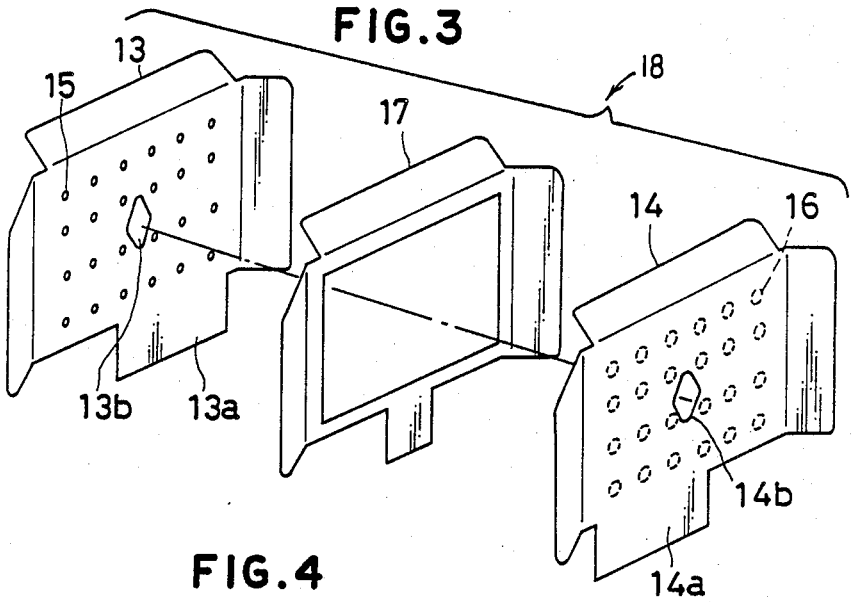
FIG. 3 is a perspective view of a device made in accordance with one embodiment of the invention.
Figure 4:
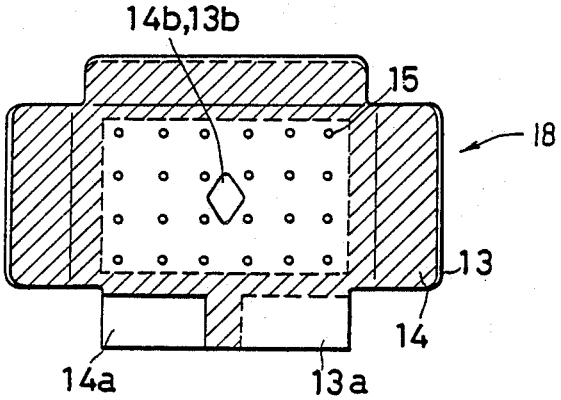
FIG. 4 is a front view of the device of FIG. 3.
Figure 5:
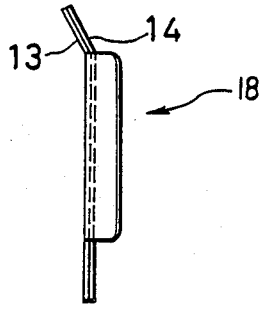
FIG. 5 is a side view of the same device.

FIG. 3 is a perspective view which illustrates a device made in accordance with an embodiment of the present invention; FIG. 4 is a front view of the same device; and FIG. 5 is a side view of the same device.

In the drawings, reference numerals 13 and 14 designate members or films formed of substrates made from polyester, or a similar material. Film 13 has an electrode portion 13*a*, a rhombus-shaped window 13*b* for passage of the printing-head pins (not shown), and a plurality of resilient rubber projections 15 on its surface which faces film 14. Film 13 is coated, e.g., by a vacuum deposition method, with a thin metal film which is, therefore, electrically conductive and (not shown), which thus forms a conductive element.

Film 14 has an electrode 14*a* which is similar to the electrode 13*a* of film 13. Film 14 also has a rhombus-shaped window 14*b* for passage of the printing-head pins (not shown. Film 14 also is coated with a conductive metal film (not separately shown, since it is a feature of the surface of the substrate which remains transparent), except for portions 16 which are located on the side of film 14 which faces film 13, and correspond to the locations of the above-mentioned rubber projections 15. The reason why portions 16 are not coated by the metal film is that the tips of the rubber projections 15 of film 13 are also coated with a layer of metal and it is necessary to avoid electrical contact between the tips of the projections 15 and the corresponding portions 16. Reference numeral 17 designates a spacer which is a tape which is adhesive on its both sides for assembling films 13 and 14 into a unit by adhesion. Tape 17 with adhesive coatings on both sides is made from an insulating material. Tape 17 also serves as a spacer between the films 13 and 14. The films 13 and 14, when assembled together with the spacer 17, form a ribbon protector 18.

The spacer for providing a predetermined distance between the conductive portions of films 13 and 14 and diminishing the distance upon application of a compressive force applied from outside can be other than the rubber projections 15 but can be for example a net-like element (not shown) which is made of a resilient material with insulating properties.

When a horizontal compressive force is developed in the device of the present embodiment, rubber projections 15 are compressed, so that conductive portions of films 13 and 14 come into contact with each other, thus becoming electrically conductive.

More specifically, because in accordance with the invention the ribbon protector 18 is installed (see FIG. 6) between a platen 1 and the printing head 2, the compressive force in the horizontal direction is created when the printing head 2 approaches the platen 1, and comes into contact with the ribbon protector 18. By appropriate positioning of the ribbon protector 18, the position of the head 2 can be detected through the conduction of the above-mentioned conductive elements 13 and 14.

Figure 6:
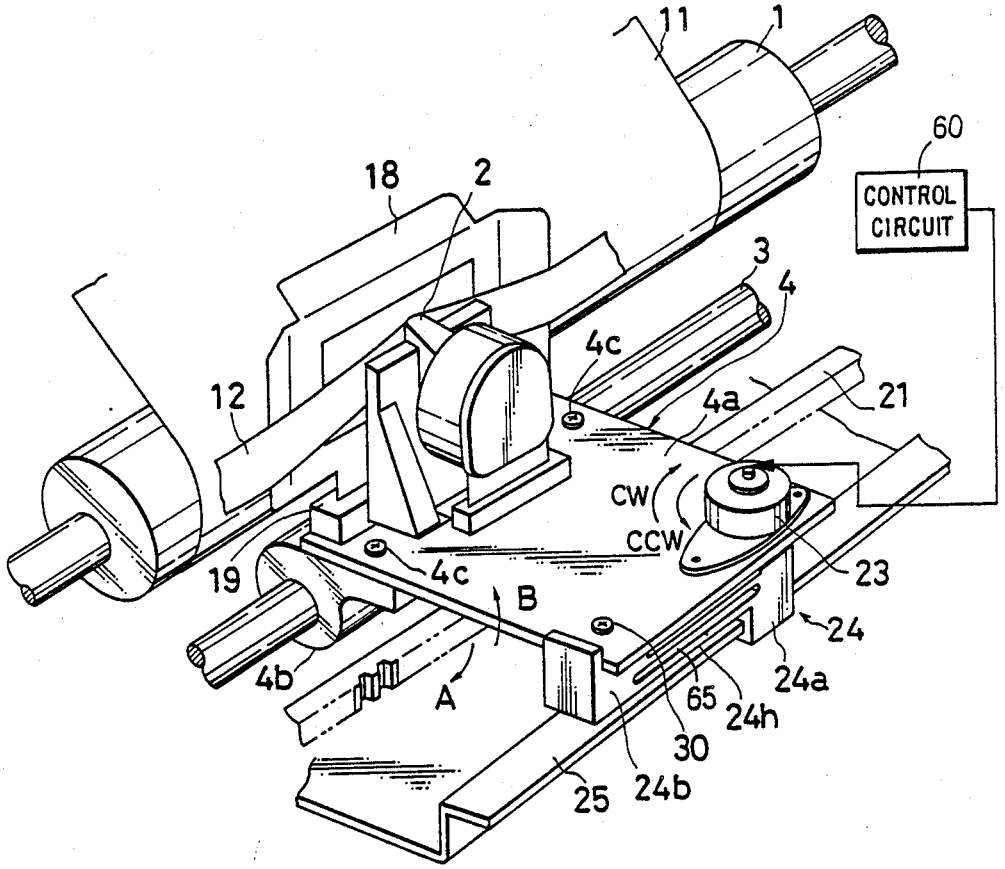
FIG. 6 is a perspective view which shows a first example of application of the device according to the invention.
Figure 7:
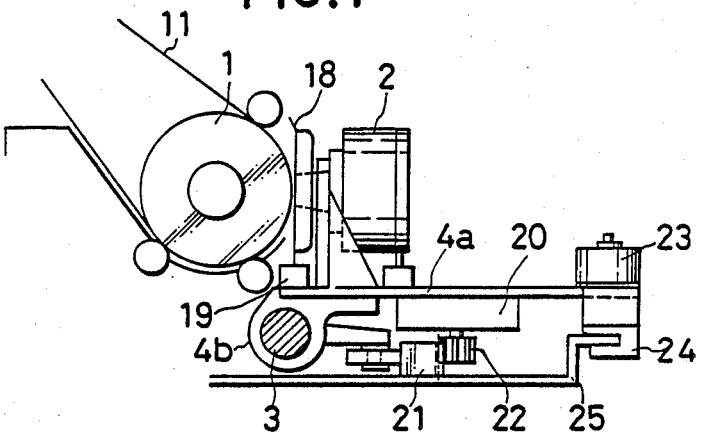
FIG. 7 is a side view of the device of FIG. 6.

FIG. 6 is a perspective view of an embodiment of platen gap adjustment device incorporating the ribbon protector 18 described with reference to FIGS. 3 to 5. FIG. 7 is a side view of the same device.

Figure 1:
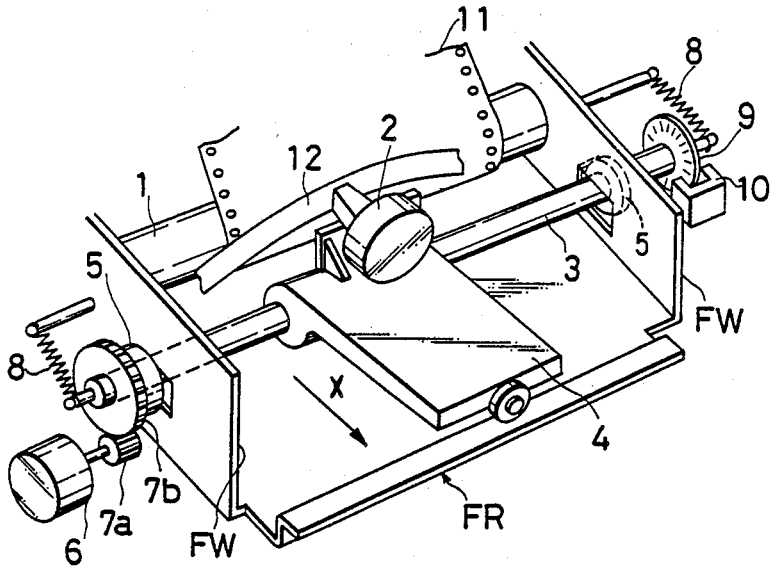
FIG. 1 PRIOR ART
FIG. 1 is a perspective view of a conventional printer adjustment device.
Figure 2:
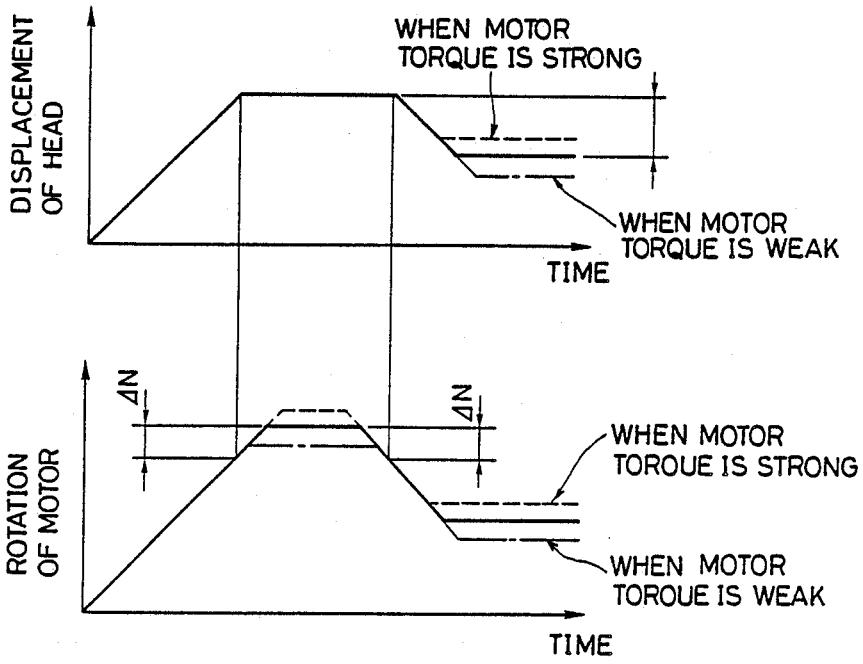
FIG. 2 PRIOR ART
FIG. 2 is a graph which shows characteristics of the conventional device of FIG. 1.

In these drawings, reference numeral 1 designates the platen around which printing paper 11 is guided. Both ends of the platen 1 are rotatably supported on side walls (not shown) similar to side walls FW of frame FR shown in FIG. 1. The printing head faces the platen 1 and performs the printing operation and is mounted on a carriage 4 which performs spacing movements along a carriage shaft 3.

The carriage shaft 3 is disposed to extend in parallel with platen 1, both ends of which are fixed on side walls (not shown).

The carriage 4 is provided with a base plate 4*a* described later and a carriage frame 4*b* having a cylindrical portion mounted rotatably on the carriage shaft 3 and movably in the axial direction. The carriage 4 is therefore rotatable around the carriage shaft 3 as well as movable along the carriage shaft 3.

The base plate 4*a* is fixed to carriage frame 4*b* by means of screws 4*c*.

Reference numeral 12 designates an ink ribbon which is set between platen 1 and printing head 2. Reference numeral 11 designates paper which is guided over platen 1 and is used as a printing medium.

The ribbon protector 18 of the present invention is shown in FIG. 3. Ribbon protector 18 is fixed to carriage 4 so that it is located in the space between paper 11 and ink ribbon 12. In the illustrated example, this attachment is performed by means of a connector 19, which is rigidly fixed to carriage 4 and serves for connection of the ribbon protector 18 to an electric circuit (shown schematically in FIG. 12) of the device. The lower end of the ribbon protector 18 is inserted into this connector 19.

Reference numeral 20 designates a spacing-movement motor which, through engagement between pinion 22 and rack 21, provides spacing motions of carriage 4 and carriage shaft 3. Spacing-movement motor 20 is mounted on the lower surface of the carriage base plate 4a.

Reference numeral 23 designates a pulse motor which is driven to adjust the platen gap of printing head 2; 24 designates a slider which supports one end of the rear end portion of carriage base plate 4a and slides along a base plate 25.

For adjustment of the platen gap, the carriage 4 is rotated about the carriage shaft 3. When it is rotated in the direction of arrow A (shown in FIG. 6), the platen gap is increased. When it is rotated in the direction of arrow B, the platen gap is decreased.

Such rotation of the carriage 4 is accomplished by the action of pulse motor 23 and slider 24. The assembly of these elements and other associated elements is best seen in FIGS. 8 and 9.

Figure 8:
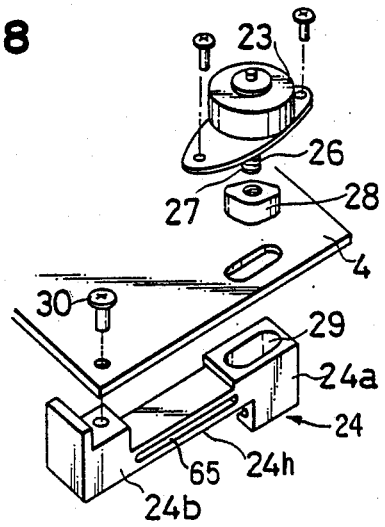
FIG. 8 is a perspective assembly view of part of the platen gap adjustment device.

FIG. 8 is an exploded perspective view showing the assembly. FIG. 9 is a partially-broken side view of the assembly.

Figure 9:
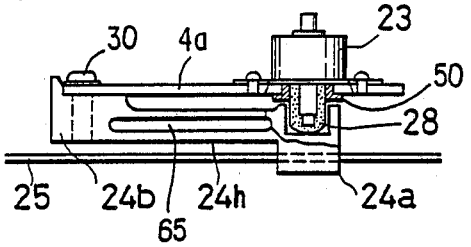
FIG. 9 is a partially-broken away front elevation view of the same part of the adjustment device.

As shown in FIGS. 8 and 9, a shaft 26 of pulse motor 23 has a right-hand thread 27. Screwed onto right-hand thread 27 is a nut 28 which has a pair of parallel flats on its outer surface.

Slider 24 comprises a parallel link 24h having a length which is almost equal to the width of carriage 4. A base plate engaging portion 24a at one end (a first end) of the slider 24 is slidably fitted on base plate 25, while a carriage-connecting portion 24b, which is located on the other end (a second end) of slider 24, is connected to a second end of the rear end portion of the carriage base plate 4a by a screw 30.

Sliding portion 24a of slider 24 which slides along the base plate 25 has an oval-shaped opening (elongated hole) 29. Nut 28 of the above-mentioned pulse motor 23 is received by a washer 50 and is fitted into opening 29, so that it cannot rotate inside this opening 29 but it can slide along the longer dimension of opening 29, and when thread 27 rotates relative to nut 28, the rotation is converted into movement along the length of thread 27. A resultant movement is a rotation of the carriage 4 about carriage shaft 3. During such movement, a parallel link 24h formed of resilient material is resiliently compressed or released.

When, in the above-described construction, pulse motor 23 rotates thread 27 in a counterclockwise direction CCW, nut 28 is pressed downward, and at the same time pushing up by reaction thread 27, pulse motor 23 and the rear end of carriage base plate 4a. Carriage 4 is thereby rotated in the direction of arrow B. Printing head 2 disposed above and fixed to carriage 4 is moved forward, toward platen 1. The platen gap is thereby reduced.

The displacement of the rear end of carriage base plate 4a pulls up the parallel link 24h connected to the rear end portion of the carriage base plate 4a. During the deformation of link 24h, part of the parallel link 24h having the oval-shaped hole 65 is moved relative to nut 28 toward the second end of the parallel link 24h. This is permitted because the hole 65 is elongated.

As thread 27 rotates in the opposite direction CW, nut 28 is moved toward pulse motor 23. The parallel link 24h tends to restore its shape and the second end of the parallel link 24h pulls down the second end of the rear end portion of the carriage base plate 4a. The carriage 4 is therefore rotated in the direction of arrow A. Printing head 2 is moved away from platen 1 and the platen gap is thereby increased.

Figure 10A:
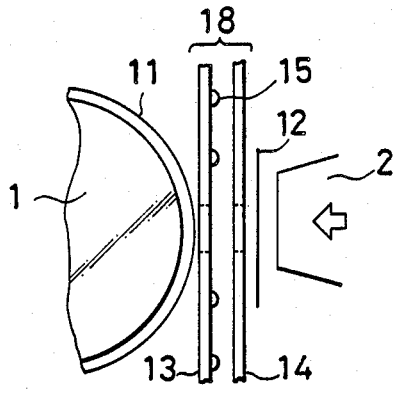
FIGS. 10A, 10B and 10C are side views which illustrate the principle of operation of the device.
Figure 10B:
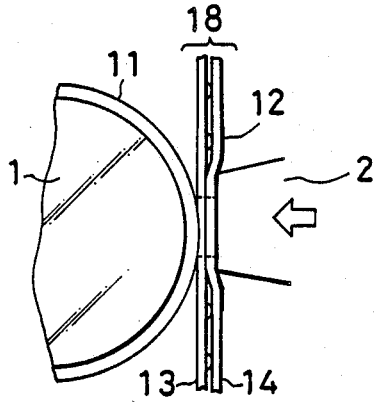
Figure 10C:
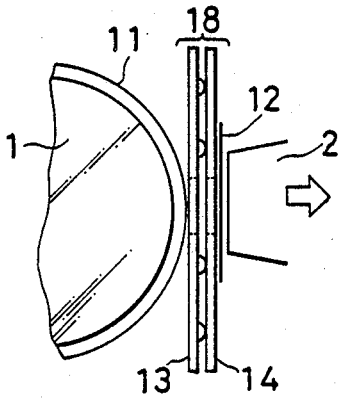

Operation of the device of the invention will now be explained with reference to FIGS. 10A, 10B and 10C, which are side views of the device. FIG. 10A shows the condition of approaching of printing head 2 to platen 1; FIG. 10B shows the moment of contact of ribbon protector 18 with platen 1; and FIG. 10C shows the condition of separation of the head 2 from platen 1.

First, pulse motor 23 turns for a predetermined amount of rotation in a clockwise direction. This rotation increases the gap between printing head 2 and platen 1. With an increased gap, the operator inserts paper 11 and guides it around platen 1.

Using as a trigger completion of the insertion of the paper 11 or an input by means of a switch, which is not shown in the drawings, rotation of pulse motor 23 in a counterclockwise direction is initiated by a control circuit or means 60 which is schematically illustrated in FIG. 6. At this moment, which is shown in FIG. 10A, printing head 2 begins to approach platen 1.

When printing head 2 comes into contact with platen 1 and assumes the position shown in FIG. 10B, rubber projections 15 of film 13 are compressed. In a compressed state, the conductive elements of films 13 and 14 are in electrical contact with each other and are conductive.

This electrical conduction makes it possible to detect the moment when the printing head 2 strikes the ribbon protector 18, which in turn strikes the paper 11 with a predetermined pressure developed in contact. Thus, detection of the paper thickness is achieved and a reference position for adjustment of the platen gap, i.e., a zero gap position, is achieved. Then pulse motor 23 is stopped. Subsequently, pulse motor 23 is turned through a predetermined amount of rotation in a clockwise direction, and the gap again is set to a value appropriate for printing.

In the embodiment described above, the platen gap adjustment mechanism has entirely automatic control. The invention can be applied also to a manual platen gap adjustment device.

Figure 11:
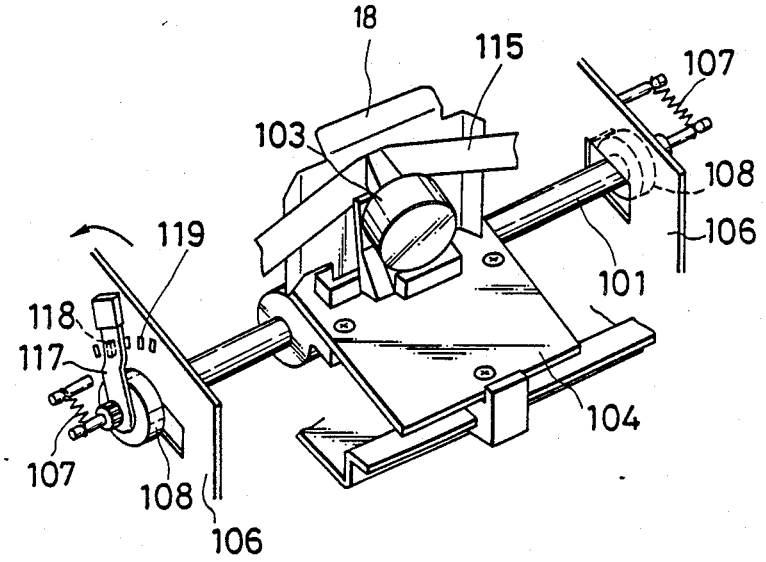
FIG. 11 is a perspective view of the printer equipped with the platen gap adjustment device of the present invention.

FIG. 11 is a perspective view of another embodiment of platen gap adjustment device incorporating the ribbon protector 18. This embodiment is featured by manual adjustment of the platen gap.

Figure 14A:
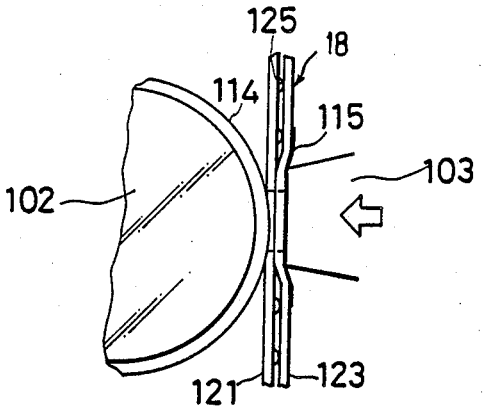
FIGS. 14A and 14B illustrate operation of the device in two positions.
Figure 14B:
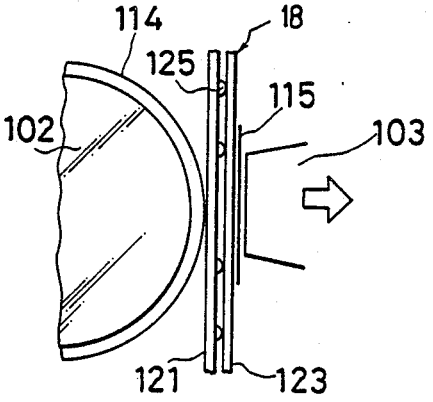

In the drawing, reference numeral 101 designates a carriage shaft, both ends of which are supported by a carriage frame 106 moveable toward or away from a platen 102 (shown in FIGS. 14A and 14B). Carriage shaft 101 is constantly urged toward platen 102 by springs 107.

Fixed at an end of carriage shaft 101 are a cam 108 and lever 117. Another cam 108 is also provided on the other end of the carriage shaft 101. A projection 118 on lever 117 is engageable with rectangular holes 119 which are formed on carriage frame 106 and arranged at an equal pitch. The engagement of the projection 118 with the holes 119 provides adjustment of the position of the carriage shaft 101 in a transverse direction.

A carriage 104 on which a printing head 103 and ribbon protector 18 are mounted is mounted slidably on carriage shaft 101. Reference numeral 115 designates an ink ribbon.

The ribbon protector 18 can be identical to the one as described with reference to FIGS. 3 to 5.

Figure 12:
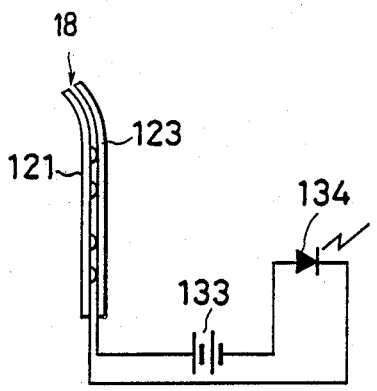
FIG. 12 is a diagram which shows an electric circuit of the device.

FIG. 12 is a circuit diagram which schematically shows an electric circuit of the platen gap adjustment device of the present embodiment.

In this drawing, the ribbon protector 18 is shown having film 121 and film 123 (which correspond, respectively, to the films 13 and 14 shown in FIGS. 10A–10C). Connected in series between the electrodes of film 121 and film 123 of the ribbon protector 18 are an electric power source 133 and a gap indicating lamp (GAP lamp) 134. In the illustrated example, GAP lamp 134 is a light-emitting diode.

Figure 13:
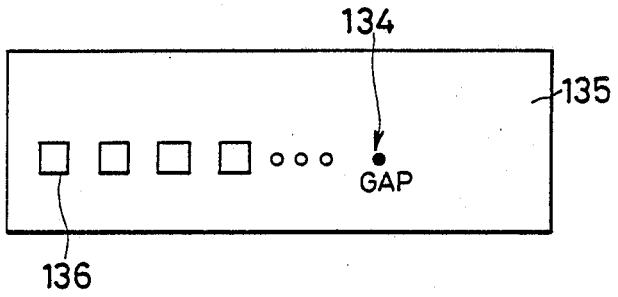
FIG. 13 is a front view of the control portion of the printer.

FIG. 13 is a front view of a control portion of the printer. In this drawing, reference numeral 135 designates a control panel on which are disposed a number of control switches 136. Installed near the switches 136 are various indicator lamps. The indicator lamp which is located on the rightmost side is the above-mentioned GAP lamp 134.

Operation of the device will now be described with reference to FIGS. 14A and 14B.

FIG. 14A shows conditions of conduction, and FIG. 14B shows conditions with an appropriate gap between the films 121 and 123.

First, paper 114 is inserted into the space between platen 102 and ribbon protector 18, and guided over the platen 102.

When lever 117 is then turned in the direction indicated by the arrow, carriage shaft 101 is moved by the action of cam 108.

As a result, ribbon protector 18 will be shifted forward, and pressed by printing head 103 to paper 114 on the platen 102.

As a result, rubber projections 125 (shown in FIG. 14A) disposed on the first film 121 are compressed, and metal films of respective films 121 and 123 come into contact to achieve electric conduction. As a result of this conduction, an electric circuit is closed, and GAP indicating lamp 134 is lit.

Lighting of GAP lamp 134 indicates that the reference position for adjustment of the platen gap is achieved.

The operator then turns lever 117 one step back from the position where indicator lamp 134 is lit. Thus, in a very simple manner, the platen gap is adjusted for one step of the lever shifting range, and this adjustment does not depend on the thickness of paper 114.

Figure 15A:
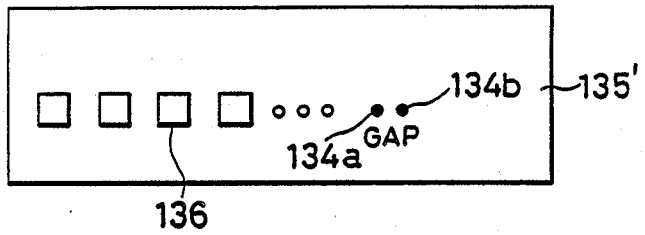
FIGS. 15A and 15B are front views of the device made in accordance with other embodiments of the invention.
Figure 15B:
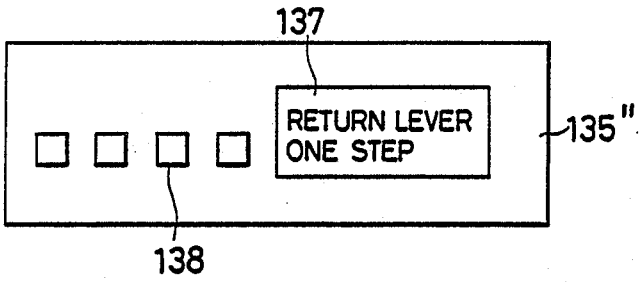

FIGS. 15A and 15B are front views illustrating the control panels of other embodiments of the invention. These embodiments are almost the same as the embodiment described above, except for the control portion of the printer.

More specifically, as shown in FIG. 15A, control panel 135' contains a red GAP lamp **134*a* and a blue GAP lamp 134*b*. Lighting of the red GAP lamp 134*a* indicates the reference position of the platen gap, while lighting of the blue GAP lamp 134*b*** indicates an appropriately adjusted value of the platen gap.

The device operates in the same manner as the above described embodiment, with the only difference that the lever 117 is moved one step back after lighting of red GAP lamp **134*a*. The gap is confirmed to have been adjusted to an appropriate value if blue GAP lamp 134*b* is lit, and red GAP lamp 134*a*** is extinguished.

In the embodiment shown in FIG. 15B, control panel 135" has an indicating portion 137, which shows a message, and selective switches 138.

First, selective switch 138 is pushed and the device is placed into an off-line condition. When the lever 117 is then turned in the gap reducing direction and the first and second films 121, 123 of the ribbon protector 18 become electrically conductive, this condition is indicated by a message on indicating portion 137 shown in FIG. 15B.

In accordance with this message, the operator turns the lever 117 one step back. As a result, the message disappears, and an appropriate platen gap is obtained.

As a modification, a buzzer can be used instead of the lamp 134 (FIG. 12).

In the illustrated embodiments, the projections 15 and 125 were made from rubber, but they can also be formed from a resilent synthetic resin. A buzzer can be used as indicating means instead of the GAP indicating lamp 134.

As has been described above in detail, in distinction from the known ribbon protector which is normally installed in front of a printing head for protecting the paper 11 from contamination by an ink ribbon, the ribbon protector 18 of the invention have a pressure detection function, so that either can be used as a means for determining the thickness of paper 11 inserted therein for detection of a zero condition of a platen gap, i.e., a reference condition of the platen gap. In this manner, the paper thickness and reference position for the platen gap adjustment can be detected without causing physical reaction. Thus, the effect of the present invention is that a predetermined distance can be maintained between the tip of the printing head 2 and the surface of the paper 11, irrespective of the paper thickness and without instabilities in the value of the adjusted gap, which in the conventional device are caused by the above-mentioned physical reaction.

The gap adjustment device described with reference to FIGS. 6 to 9, 10A, 10B and 10C makes it possible to detect the reference position of the printing head 2, and to detect the thickness of the paper 11 that is set and to obtain the reference position for the platen gap adjustment without causing physical reactions in various elements of the gap adjustment mechanism. Thus, the effect of the present invention is that a predetermined distance can be maintained between the tip of the printing head 2 and surface of the paper 11, irrespective of the paper thickness and without instabilities in the value of the adjusted gap, which in the conventional device are caused by the above-mentioned indirect adjustment and physical reaction.

Furthermore, the invention makes it unnecessary to increase the overall dimensions of the device, as all drive means for the adjustment mechanism are located entirely on the carriage 4.

Because in the device of the present invention a distance between the tip of the printing head 2 and paper 11 is maintained at a predetermined value irrespective of the paper thickness, the invention also results in an improved quality of printing, protection of head pins (of the printing head 2) against breakage, protection of paper 11 against contamination by the ink ribbon 12, and elimination of instability in carriage spacing movements.

Moreover, the platen gap adjustment device described with reference to FIGS. 11 to 15B has the following advantages.

First, the device eliminates instability in the return stroke and provides reliable adjustment of the platen gap. This, in turn, protects the printer from a reduction in the quality of printing, prevents breakage of the printing head pins (of the printing head 12B), protects paper 11 from contamination by the ink ribbon 115, and eliminates unstable movement of the carriage 104.

Secondly, performance of the adjustment of the platen gap through the ribbon protector 18 improves the accuracy of the adjustment.

Moreover, because the appearance of the ribbon protector 18 remains unchanged from the prior art, there is no biased feeling as to something different.

Further, the provision of indicating means 134 makes it possible to simplify the construction of the shifting means, to reduce the number of parts, and thus to reduce the cost of the device.

What is claimed is:

1. A platen gap adjustment device for use in a printer for adjustment of a gap between a tip of a printing head and a surface of a paper installed between a platen and a ribbon protector of the printer, the printing head being mounted on a carriage which is rotatably and slidably mounted on a carriage shaft which extends parallel to the platen to permit a spacing movement of said carriage along said platen comprising:

displacement means for displacing the rear end of said carriage to rotate said carriage about said carriage shaft so that said tip of said printing head is moved selectively toward and away from said platen; said displacement means including a parallel link element connected at one end to said rear end of said carriage and slidably fitted at the other end with a guide which is generally parallel to said platen;

said ribbon protector having an electrode which is conductive when a predetermined pressure is applied to said electrode during adjustment;

said carriage having a connector which receives said electrode;

drive means for driving said displacement means to obtain a reference position of said carriage for the adjustment of said platen gap based on conduction of said electrode of said ribbon protector; said drive means including a gap adjustment motor which causes said parallel link element to be resiliently deformed;

a control means for controlling operation of said gap adjustment motor, said gap adjustment motor and said control means being mounted on said carriage;

wherein, when said gap adjustment motor rotates in a predetermined direction, said parallel link element is resiliently deformed and said carriage is rotated about said carriage shaft in a first direction causing said tip of said printing head to be moved toward said platen;

when said gap adjustment motor rotates in an opposite direction, pressure on said parallel link element is released such that said parallel link element returns toward its original shape, causing said carriage to move about said carriage shaft in a second direction, thereby causing said tip of said printing head to be moved away from said platen; and when, during rotation of said gap adjustment motor in said predetermined direction, said printing head reaches a position in which said tip of said printing head develops a predetermined pressure against said surface of said paper, said predetermined pressure is detected by conduction of said electrode of said ribbon protector, said position being determined by said control means as said reference position for said gap adjustment, said gap adjustment motor then being driven in said opposite direction through a predetermined angle of rotation of said carriage so that said tip of said printing head is pulled away from said platen so as to obtain a predetermined platen gap.

2. A ribbon protector, for use in a printer of the type which has a platen for supporting a sheet, an ink ribbon, and a printing head, for sensing applied pressure and for protecting the sheet from contamination by the ink ribbon in the printer, the ribbon protector being disposed between the platen and the printing head, comprising:

a protector body including a first member having a through-opening disposed between the printing head and the platen, and a second member disposed adjacent to said first member having a through-opening adjacent said through-opening of said first member disposed between the printing head and the platen;

said first and second members each respectively including a substrate which is electrically nonconductive; said first and second members having respective adjacent facing inner surfaces and a coating of an electrically conductive material on each of said inner surfaces; said inner surface of said first member having a plurality of resiliently deformable projections separating said inner surfaces;

said protector body having an undeformed condition wherein said facing surfaces are electrically isolated from each other, and a deformed condition wherein the respective said coatings of electrically conductive material on said first and second members are in electrical contact, thereby enabling detection of said deformed condition.

3. A ribbon protector according to claim 2, wherein each of said plurality of resiliently deformable projections have approximately equal respective heights.

4. A ribbon protector according to claim 2, further comprising a spacer disposed between said first and second members for maintaining electrical separation of said first and second members.

5. A ribbon protector according to claim 4, wherein said spacer comprises a sheet-like member which has two surfaces which are adhesive, each of said two surfaces adhesively connecting a respective one of said first and second members.

6. A platen gap adjustment device for adjustment of a platen gap in a printer between a printing head and a surface of a sheet supported on a platen, the printer having an ink ribbon, a carriage shaft, and a carriage movable along the carriage shaft for supporting the printing head, the printing head being mounted for movement along said carriage shaft, comprising:

a ribbon protector for detecting a predetermined condition and for protecting paper from contamination by the ink ribbon, said ribbon protector being disposed between the sheet and said ink ribbon, said ribbon protector having a through-opening disposed between the printing head and the platen, said ribbon protector having means for completing an electrical circuit upon occurrence of said predetermined condition, said predetermined condition corresponding to a selected position of said printing head relative to said sheet; said ribbon protector having a first member and a second member which have respective facing inner surfaces; each of said first and second members including an electrically insulating substrate and a coating of an electrically conductive material on its respective said inner surface; one of said inner surfaces having a plurality of resiliently deformable projections which are electrically insulating; said ribbon protector having an undeformed condition wherein said inner surfaces are electrically isolated from each other and a deformed condition when said predetermined condition exists wherein the respective said coatings of an electrically conductive material on said first and second members are in electrical contact with each other so as to enable detection of said predetermined condition;

displacement means for displacing a rear end of said carriage to rotate said carriage about said carriage shaft so that said printing head is moved selectively toward and away from said platen; said displacement means including a parallel link element connected at one end to said rear end of said carriage, said parallel link element being slidably fitted at the other end with a guide which is generally parallel to said platen;

drive means for driving said displacement means to obtain a reference position of said carriage for the adjustment of said platen gap based on detection of said predetermined condition; said drive means including a gap adjustment motor which causes said parallel link element to be resiliently deformed;

a control means for controlling operation of said gap adjustment motor, said gap adjustment motor and said control means being mounted on said carriage;

wherein, when said gap adjustment motor rotates in a predetermined direction, said parallel link element is resiliently deformed and said carriage is rotated about said carriage shaft in a first direction causing said printing head to be moved toward said platen;

when said gap adjustment motor rotates in an opposite direction, said parallel link element is caused to return toward its original shape, causing said carriage to move about said carriage shaft in a second direction, thereby causing said printing head to be moved away from said platen; and when, during rotation of said gap adjustment motor in said predetermined direction, said printing head is moved into a position wherein said predetermined condition exists, said predetermined condition is detected by said ribbon protector, and said position is determined by said control means as said reference position for said gap adjustment, said gap adjustment motor then being driven in said opposite direction through a predetermined number of revolutions so that said printing head is pulled away from said platen, to obtain a predetermined size of said platen gap.

7. A platen gap adjustment device for adjustment of a platen gap in a printer between a printing head and a surface of a sheet supported on a platen, the printer having an ink ribbon, and a carriage carrying said printing head being mounted for movement along a carriage shaft, comprising:

a ribbon protector for detecting a predetermined condition and for protecting paper from contamination by the ink ribbon, said ribbon protector being disposed between the sheet and said ink ribbon, said ribbon protector having a through-opening disposed between the printing head and the platen, said ribbon protector having means for completing an electrical circuit upon occurrence of said predetermined condition, said predetermined condition corresponding to a selected position of said printing head relative to said sheet; said ribbon protector having a first member and a second member which have facing inner surfaces; each of said first and second members including an electrically insulating substrate and a coating of an electrically conductive material on its respective said inner surface; one of said inner surfaces having a plurality of resiliently deformable projections which are electrically insulating; said ribbon protector having an undeformed condition wherein said inner surfaces are electrically isolated from each other and a deformed condition when said predetermined condition exists wherein the respective said coatings of electrically conductive material are in electrical contact with each other so as to enable detection of said predetermined condition;

displacement means for displacing a rear end of said carriage to rotate said carriage about said carriage shaft so that said printing head is moved selectively toward and away from said platen; said displacement means including a manually operable mechanism for changing the size of said platen gap; a control means for detecting electrical conduction between said inner surfaces of said first and second members, and an indicator controlled by said control means which indicates when said electrical conduction is detected.

8. A platen gap adjustment device according to claim 7, wherein said indicator produces a visually perceptible indication to indicate detection of said electrical conduction.

9. A platen gap adjustment device according to claim 7, wherein said manually operable mechanism further comprises a manually operable lever, means movable together with said lever for changing said platen gap, and lever fixing means for fixing said lever in a selectable one of a plurality of predetermined positions.

* * * * *

UNITED STATES PATENT AND TRADEMARK OFFICE

CERTIFICATE OF CORRECTION

PATENT NO. : 4,929,102

DATED : May 29, 1990

INVENTOR(S) : Minoru MIZUTANI ET AL.

It is certified that error appears in the above-identified patent and that said Letters Patent is hereby corrected as shown below:

On the title page, item [73] as follows:

-- [73] Assignee: Oki Electric Industry Co., Ltd., Tokyo, Japan --

Signed and Sealed this

Eighth Day of October, 1991

*Attest:*

HARRY F. MANBECK, JR.

*Attesting Officer*

*Commissioner of Patents and Trademarks*